US008487226B2

(12) United States Patent
Biswell

(10) Patent No.: US 8,487,226 B2
(45) Date of Patent: Jul. 16, 2013

(54) DECONFLICTION OF GUIDED AIRBORNE WEAPONS FIRED IN A SALVO

(75) Inventor: Brian L. Biswell, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 232 days.

(21) Appl. No.: 13/050,600

(22) Filed: Mar. 17, 2011

(65) Prior Publication Data

US 2012/0234966 A1 Sep. 20, 2012

(51) Int. Cl.

| | |
|---|---|
| ***F41G 7/20*** | (2006.01) |
| ***F42B 15/01*** | (2006.01) |
| *F41G 7/00* | (2006.01) |
| *F42B 15/00* | (2006.01) |

(52) U.S. Cl.

USPC ..... 244/3.17; 244/3.1; 244/3.15; 244/3.16; 89/1.11; 342/61; 342/62

(58) Field of Classification Search

USPC ..... 244/3.1–3.3; 89/1.11, 1.1; 382/100, 382/103; 701/1, 120–122, 400, 408, 519, 701/300, 301; 342/61–66, 175, 176, 179, 342/195

See application file for complete search history.

(56) References Cited

U.S. PATENT DOCUMENTS

| | | | | | |
|---|---|---|---|---|---|
| 4,274,609 | A | * | 6/1981 | Ferrier et al. | 244/3.14 |
| 4,848,208 | A | * | 7/1989 | Kosman | 89/1.11 |
| 5,153,366 | A | * | 10/1992 | Lucas | 89/1.11 |
| 5,206,452 | A | * | 4/1993 | Stamper et al. | 89/1.11 |
| 5,273,236 | A | | 12/1993 | Wootton | |
| 5,511,218 | A | * | 4/1996 | Castelaz | 89/1.11 |
| 5,855,339 | A | * | 1/1999 | Mead et al. | 244/3.11 |
| 5,992,288 | A | * | 11/1999 | Barnes | 89/1.11 |
| 6,196,496 | B1 | * | 3/2001 | Moskovitz et al. | 244/3.15 |
| 6,497,169 | B1 | * | 12/2002 | Khosla | 89/1.11 |
| 6,796,213 | B1 | * | 9/2004 | McKendree et al. | 89/1.11 |
| 7,024,309 | B2 | * | 4/2006 | Doane | 701/301 |
| 7,032,858 | B2 | * | 4/2006 | Williams | 244/3.15 |
| 7,212,917 | B2 | * | 5/2007 | Wilson, Jr | 701/120 |
| 7,219,853 | B2 | * | 5/2007 | Williams | 244/3.14 |
| 7,494,090 | B2 | * | 2/2009 | Leal et al. | 244/3.16 |
| 7,734,386 | B2 | * | 6/2010 | DelNero et al. | 244/3.15 |
| 7,757,595 | B2 | * | 7/2010 | Khosla et al. | 89/1.11 |
| 7,912,631 | B2 | * | 3/2011 | Howard et al. | 701/519 |
| 8,288,699 | B2 | * | 10/2012 | Romero et al. | 244/3.15 |
| 2005/0188826 | A1 | * | 9/2005 | McKendree et al. | 89/1.11 |

FOREIGN PATENT DOCUMENTS

WO 9608688 A1 3/1996

* cited by examiner

*Primary Examiner* — Bernarr Gregory
(74) *Attorney, Agent, or Firm* — Eric A. Gifford

(57) ABSTRACT

Guided airborne weapons fired in a salvo against multiple targets are deconflicted by performing a scene correlation of multiple cued targets to TLOs acquired by the seeker's imaging sensor to track a target package. If the weapon is provided with a multimode seeker, target cues for a common designated target and a common SAL code are provided to each weapon. Each weapon uses its SAL sensor to detect and process a SAL return to verify the common SAL code and augment their scene correlations by fixing the TLO track file of the common designated target to the cued track file associated with the designated target. At terminal, each weapon commits to a particular target by referencing its assigned target to the tracked target package. Correlation to multiple targets in the target package makes the acquisition and tracking process more robust and reduces targeting ambiguity. Furthermore, a single SAL designation can improve the tracking of all the weapons to their respective targets.

25 Claims, 13 Drawing Sheets

DECONFLICTION OF GUIDED AIRBORNE WEAPONS FIRED IN A SALVO

GOVERNMENT RIGHTS

This invention was made with United States Government support under Contract Number W31P4Q-08-C-A789 with the United States Army. The United States Government has certain rights in this invention.

BACKGROUND OF THE INVENTION

1. Field of the Invention

This invention relates to deconfliction of guided airborne weapons fired in a salvo against a group of targets. The invention is applicable to weapons provided with either a single mode seeker that includes an imaging sensor such as an active RF/MMW or passive EO (e.g. IR) or a multimode seeker that includes one or more imaging sensors and a non-imaging semi-active laser (SAL) sensor.

2. Description of the Related Art

A guided missile maneuvers in response to guidance signals to impact a target. A class of guided missiles referred to as Lock On After Launch (LOAL) are provided an initial target cue (e.g. time-stamped position, velocity and uncertainties of both and possibly target discriminators), which may be updated with in-flight target updates (IFTUs). The missile propagates a cued track file for the target based on the initial target cue and any IFTUs. The track file estimates the position, velocity and uncertainty volume of the target. A target's uncertainty volume is that volume of space in which a target could reasonably be expected to be based on the initial cues and any IFTUs, changes in target motion since the last cue and uncertainty in the weapon's position.

Once the missile is within range, the seeker searches the uncertainty volume looking for target-like objects (TLOs) that have a signature of a possible target based on position, speed, brightness (IR), strength of return (RF) or other discriminators such as size or shape and correlates each TLO track file with the cued track file to find the best match. The seeker may include an imaging sensor such as a passive electro-optical (EO) sensor (e.g. an infrared (IR) sensor) or an active radio frequency (RF) or millimeter wave (MMW) sensor or some combination thereof to acquire and track the TLOs. The seeker may search the uncertainty volume by using a fixed wide field of view (FOV) sensor, maneuvering the missile, slewing the seeker via a gimbal or, in the case of RF or MMW sensors, by electronically scanning the FOV.

A multimode seeker also includes a semi-active laser (SAL) sensor that tracks laser energy provided by a laser designator (e.g. a ground or airborne designator) reflected off a target or nearby landmark (known as "offset designation"). The laser pulses are coded and must match the code keyed into the missile prior to launch.

If the target is not illuminated with a laser, the multimode seeker uses the imaging sensor to select the likeliest TLO and maneuver to impact. If the target is illuminated with a laser, the multimode seeker uses the SAL information to confirm or override the correlation match. If the laser is left on until impact (known as "SAL designation"), the missile seeker tracks the laser information all the way to impact ignoring the imaging sensor image and correlation. If the laser is only on a brief period (known as "SAL anoint"), the missile seeker finds the closest TLO to the cue and uses the imaging sensor(s) to track the TLO to impact.

If as illustrated in FIGS. 1*a* through 1*c* multiple LOAL guided missiles 10 are fired in a salvo to enter the same target space 12 and prosecute multiple targets 14 simultaneously, the likelihood that targeting conflicts or ambiguity will arise is quite high. As the missiles fly toward the target space, the uncertainty volume 16 associated with a target cue 18 grows increasing the possibility that the uncertainty volumes for different targets will overlap and cause a conflict or ambiguity. Each missile scans a search volume 20 that spans the uncertainty volume 16 for its target cue 18. Multiple missiles may track and commit to the same target leaving one or more targets safe. In fact, for closely spaced targets it is quite likely that all of the missiles may select the same target.

This problem may be solved by simultaneously illuminating each target with a different laser designator having a different laser code. Each missile is keyed with a different one of these codes. Each missile acknowledges only the SAL return for which it is keyed and tracks that designation to impact. Unfortunately, this solution is neither cost effective, practical or safe in a combat environment.

Instead the current solution is to provide a single laser designator and key all of the missiles to the same laser code. The missiles are fired sequentially. Each missile acquires and tracks the SAL designation to impact a target. The designator moves from one target to the next until all of the missiles have been fired to prosecute the set of targets. The approach resolves the targeting ambiguity but sacrifices the benefits of firing a salvo of missiles. The benefits of prosecuting the target space with a salvo include maintaining an element of surprise on the enemy and minimizing the exposure of both the laser designator and the missile launch platform(s).

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides a method for deconflicting guided airborne weapons such as self-propelled missiles, gun-launched projectiles or dropped bombs launched in a salvo against multiple targets in a target space. The technique applies to guided airborne weapons provided with either a single mode seeker that includes an imaging sensor such as an active RF/MMW or a passive EO sensor (e.g. IR) or a multimode seeker that includes one or more imaging sensors and a non-imaging semi-active laser (SAL) sensor.

In an embodiment, each weapon is provided with a target package including individual target cues of initial position, velocity and uncertainty estimates for a plurality of targets and a target ID for the weapon. A single uniform target package including individual cues for all of the targets may be passed to each of the weapons. In flight, each weapon propagates a cued track file for each target in its target package and performs a scene correlation of the cued track files to TLO track files for target like objects (TLOs) acquired by the imaging sensor to track the target package. At terminal, each weapon commits to a particular target by referencing its assigned target to the tracked target package. Correlation to multiple targets in the target package instead of just the assigned target makes the acquisition and tracking process more robust and reduces targeting ambiguity.

In another embodiment, each weapon includes a multimode seeker. The target packages include target cues for a common designated target and a common SAL code. A single uniform target package including individual cues for all of the targets including the common designated target and SAL code may be passed to each of the weapons. Alternately, each target package may comprise only the individual cues for the designated target and the assigned target for that weapon. The weapons use the SAL sensor to detect and process a SAL return to verify the common SAL code and augment their scene correlations by fixing the TLO track file of the common designated target to the cued track file associated with the designated target ID. At terminal, each weapon references its target ID to the augmented scene correlation of its target package to commit to a particular target. The designated target may or may not be assigned to one of the weapons. In fact the weapons may in some cases implement logic that prevents them from committing to the designated target. In this manner, a single SAL designation can improve the tracking of all the weapons to their respective targets.

In an embodiment, the weapon performs scene correlation by defining a template that comprises a plurality of nodes that map each of the cued track files in the target package to an assigned target. The weapon selects a permutation that assigns a TLO track file to each of the template nodes. The weapon suitably determines whether the permutation is valid e.g. each of the assigned TLOs is within the uncertainty volume of the weapon and cued track file to which it is assigned. The weapon computes a multi-dimensional cost function between the cued track files in the template and the TLO track files in the selected permutation. The weapon ranks the permutation based on the cost function and repeats the process for a different permutation until the weapon is within commit range. At this point, each weapon selects its assigned target (one of the nodes in the template) from the highest ranked permutation.

In one embodiment, the template may place no constraints on the relative positions of the cued targets. In this case, the cost function may be the sum of the squared distances between each cued track file and its assigned TLO. In another embodiment, the knowledge of the relative positions of the cued track files based on the initial cues and any IFTUs may be used to further constrain the scene correlation. In this case, the weapon shifts (e.g. translates, rotates, etc.) the template to provide a best fit to the TLO track files. The cost function is weighted sum of a metric of the best fit and a metric of the degree of shift required to achieve the best fit. For example, a metric of the best fit may be a sum of the squared distances between the shifted nodes and the TLO track files and the metric of the shift may be the squared distance the template was shifted. In either case, if a common SAL designation is available, the TLO track file of the designated target is fixed to the node in the template of the cued track file associated with the designated target ID.

These and other features and advantages of the invention will be apparent to those skilled in the art from the following detailed description of preferred embodiments, taken together with the accompanying drawings, in which:

DETAILED DESCRIPTION OF THE INVENTION

Figure 1A:
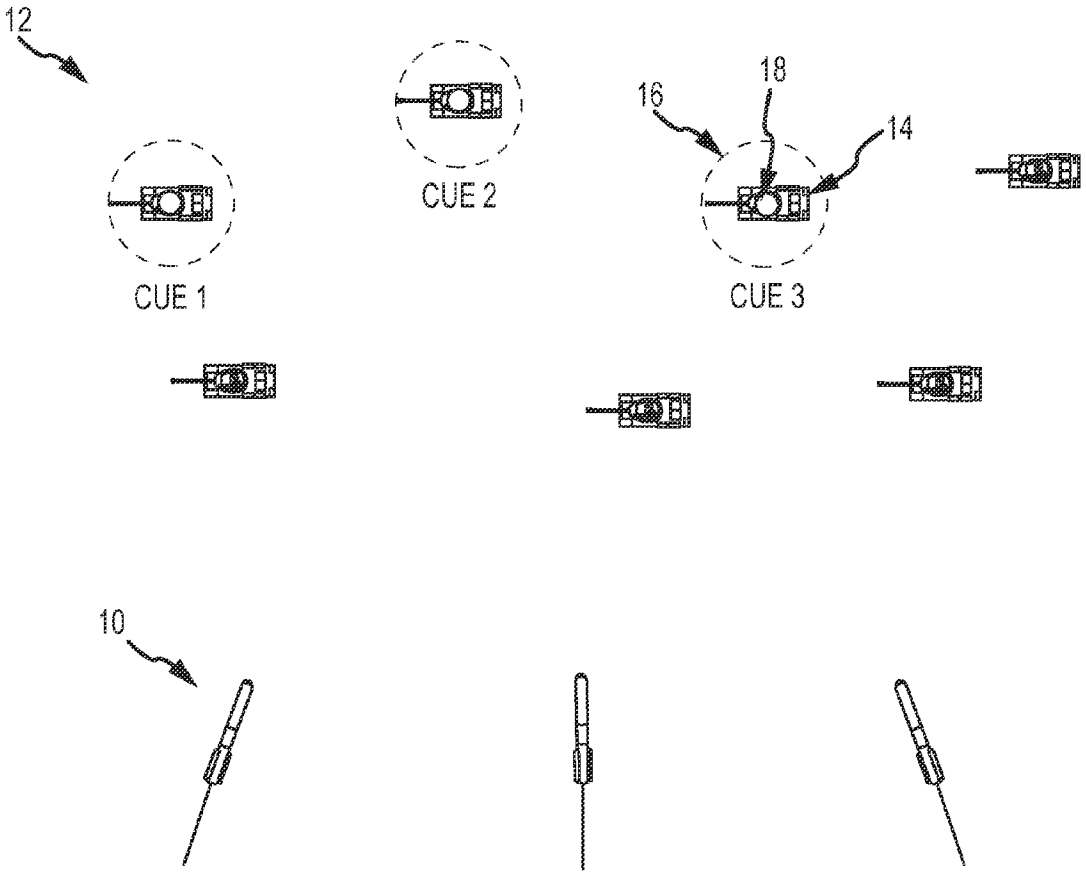
FIG.1a (PRIOR ART)
FIGS. 1*a* through 1*c*, as described above are diagrams of a salvo of missiles engaging multiple targets in a target space and the ambiguity of overlapping uncertainty regions.
Figure 1B:
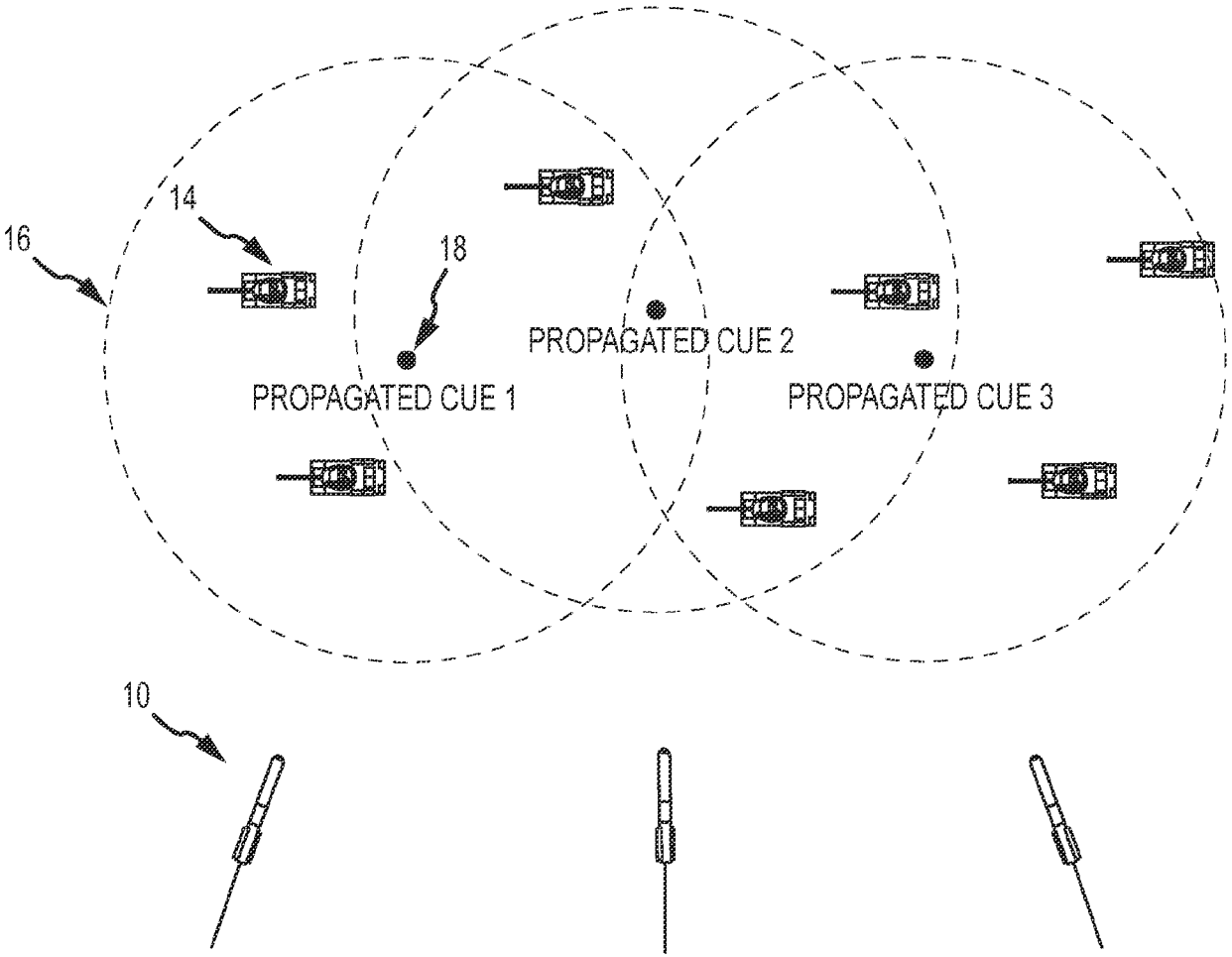
FIG. 1b (PRIOR ART)
Figure 1C:
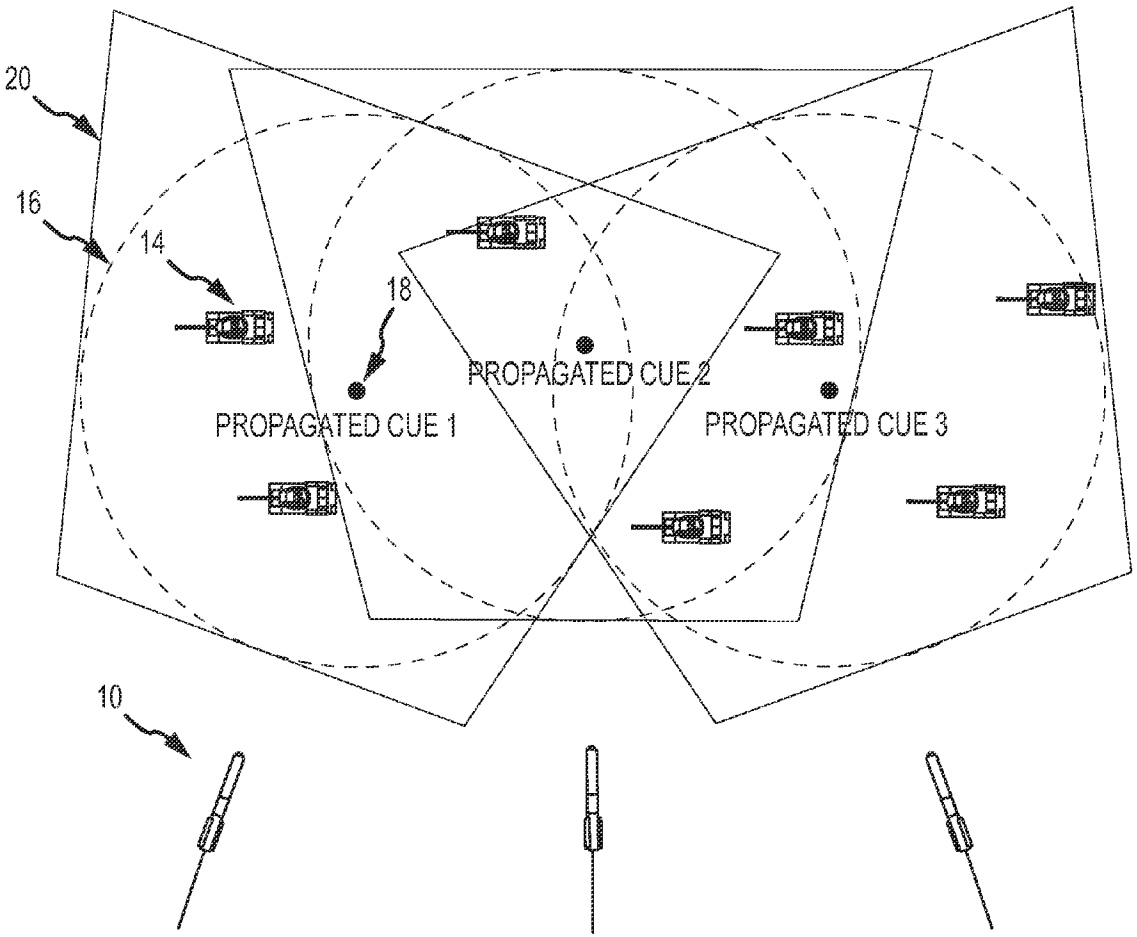
FIG. 1c (PRIOR ART)

In the present invention, guided airborne weapons fired in a salvo against multiple targets are deconflicted by performing a scene correlation of multiple cued targets to TLOs acquired by the seeker's imaging sensor to track a target package. If the weapon is provided with a multimode seeker, target cues for a common designated target and a common SAL code are provided to each weapon. Each weapon uses its SAL sensor to detect and process a SAL return to verify the common SAL code and augment their scene correlations by fixing the TLO track file of the common designated target to the cued track file associated with the designated target. At terminal, each weapon commits to a particular target by referencing its assigned target to the tracked target package. Correlation to multiple targets in the target package makes the acquisition and tracking process more robust and reduces targeting ambiguity. Furthermore, a single SAL designation can improve the tracking of all the weapons to their respective targets.

The present invention may be implemented for a variety of guided LOAL airborne weapons ranging from guided self-propelled missiles, gun-launched guided projectiles to guided bombs. The weapons may be provided with either a single mode seeker that includes an imaging sensor such as an active RF/MMW or passive EO (e.g. IR) or a multimode seeker that includes one or more imaging sensors and a non-imaging semi-active laser (SAL) sensor.

An aspect of the invention is that a target package comprising cues for multiple targets is passed to each weapon. The initial cues may be generated from the launch platform or an external cueing source such as a UAV. This target package may have many different configurations. The "targets" may include actual targets assigned to one or the weapons or may include reference targets included to reduce ambiguity. The "targets" may include a common SAL designated target, which may or may not be assigned to a weapon. The common SAL designated target may be a specified one of the cued targets, may be any one of the cued targets, may be an offset designated to a cued target or may be a reference target.

One specific target package may include all of the targets assigned to missiles in the salvo. Another specific target package may include all of the targets assigned to missiles in the salvo of which one is the common SAL designated target (and the SAL code). In either of these cases, the same target package is passed to each of the weapons. Another specific target package may include a target assigned to a particular missile and the common SAL designated target (and SAL code).

Without loss of generality, an embodiment of the present invention directed to a LOAL guided missile provided with a multimode seeker in which each missile is passed a uniform target package including cues for each missile in the salvo of which one is a common SAL designated target will now be described. One of ordinary skill in the art will understand that the described techniques will apply to different weapon systems, single and multimode seekers and target package configurations.

Figure 2:
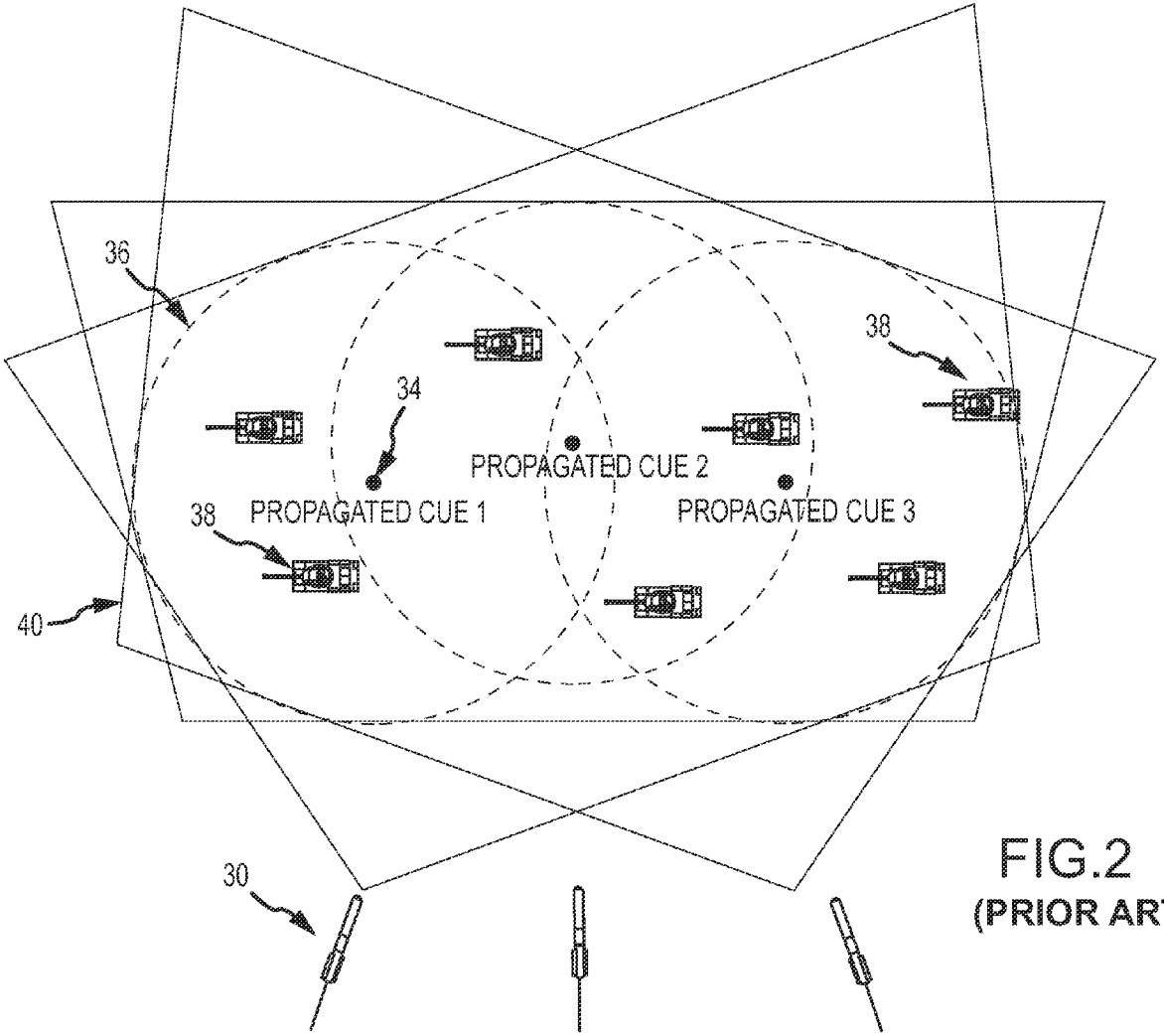
FIG.2 (PRIOR ART)
FIG. 2 is a diagram illustrating a search volume that spans the uncertainty volumes for multiple cued targets provided as a target package to each missile.

As shown in FIG. 2, each missile 30 has initiated and propagated a cued track file for each of the cued targets in the target package. The cued track file may include a position estimate 34 and a position uncertainty volume 36, a velocity and a velocity uncertainty volume as well as a time stamp and target discriminators (e.g. size, shape etc.). When the missile is within range of its imaging sensor, the missile acquires and tracks TLOs 38 by initiating and propagating a TLO track file for each. As shown, the uncertainty volumes 36 include multiple TLOs 38 and overlap with the uncertainty volumes 36 for other missiles in the salvo.

To reduce targeting ambiguity and conflict, each missile 30 uses its imaging sensor to image a search volume 40 to acquire target like objects (TLOs) and propagate TLO track files for all of the cued targets in the target package. The imaging sensor suitably images a search volume 40 that spans the combined uncertainty volumes 36 of all the targets in the target package to acquire target like objects (TLOs). Typically, the FOV of the imaging sensor is not large enough to image the entire search volume 40 in a single image, particularly as the range to target decreases, and thus must be scanned over the search volume 40. This may be done by maneuvering the missile, slewing a gimbal on which the seeker is mounted or, in the case of RF or MMW sensors electronically scanning the search volume. As the range to target decreases, it may not be possible to scan a search volume that fully spans the combined uncertainty volumes of all of the targets. This may result in having to perform a partial scene correlation in which one or more of the cued targets are dropped.

Figure 3:
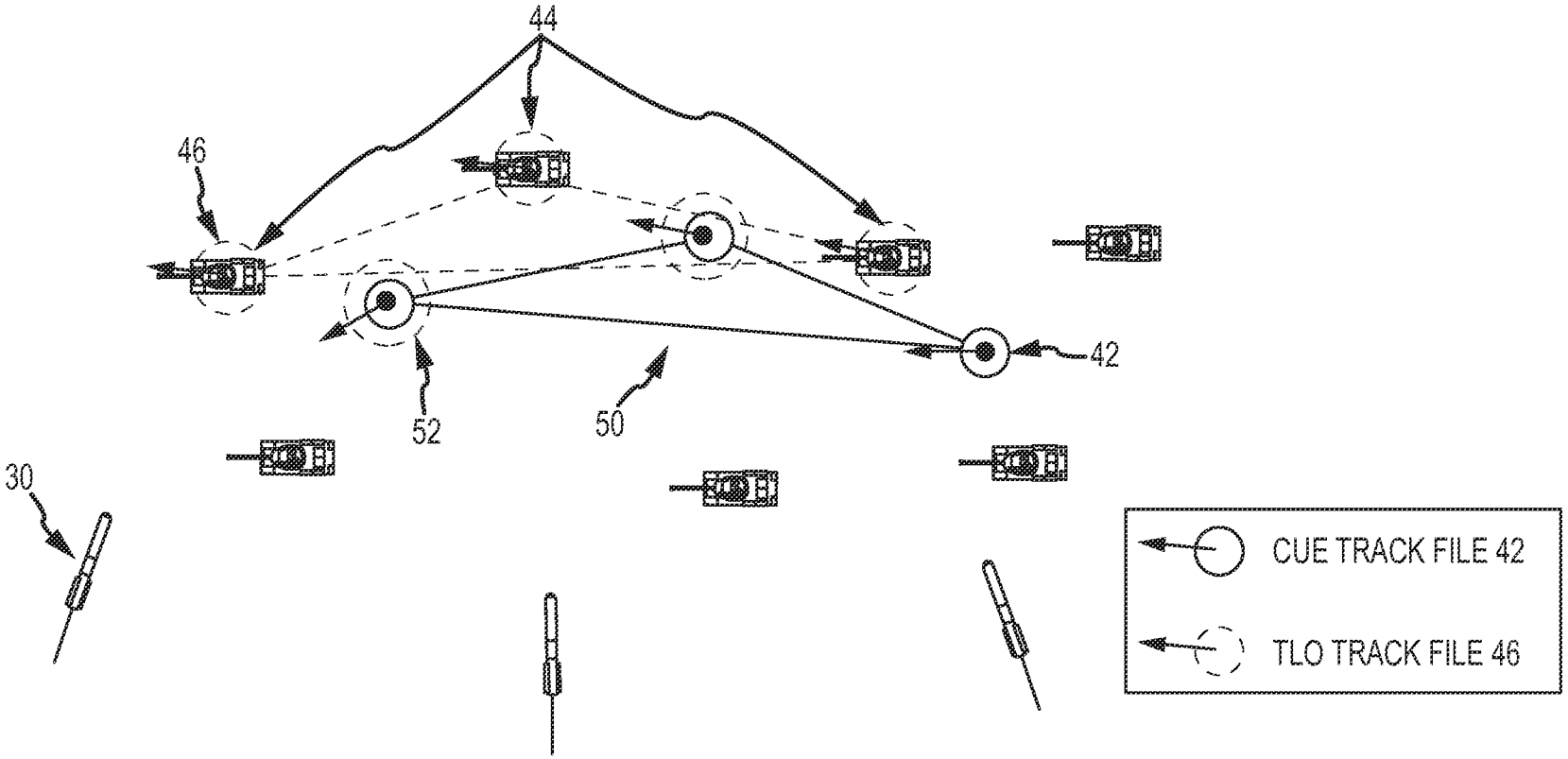
FIG. 3 is a diagram illustrating the scene correlation of a cued target package to TLOs in the target space to remove the ambiguity in accordance with the present invention.

As shown in FIG. 3, each missile 30 performs a scene correlation of cued track files 42 to different permutations 44 of TLO track files 46 to acquire and track the target package. Once the weapon is within commit range, the weapon selects its assigned target from the tracked target package (e.g. the highest ranked permutation) and commits. Each weapon is performing essentially the same scene correlation (with allowances for partial scene correlation, differences in angles of attack and variations in arrival time in the target space) and then selecting its assigned target. The performance of a scene correlation to multiple TLOs in the target package instead of just the assigned target makes the acquisition and tracking process more robust and reduces targeting ambiguity among the multiple weapons.

In an embodiment, the weapon performs scene correlation by defining a template 50 that comprises a plurality of nodes 52 that map each of the cued track files 42 in the target package to an assigned target. The weapon selects a permutation 44 of all the TLO track files that assigns a TLO track file 46 to each of the template nodes 52. In most cases, each weapon, hence each node is assigned to a different target and TLO track file. However, in some cases it may be desirable to assign multiple weapons, hence nodes to a single target. The weapon suitably determines whether the permutation is valid e.g. is each of the assigned TLOs 38 within the uncertainty volume 36 of the weapon and cued track file to which it is assigned? The use of a scene correlation in which the template assigns different nodes to different targets reduces targeting ambiguity and inhibits multiple weapons from incorrectly selecting the same target.

The weapon computes a multi-dimensional cost function between the cued track files 42 in the template 50 and the TLO track files 46 in the selected permutation 44. The cost functions measures a "distance" between the cued targets in the target package and the permutation. The "distance" metric may take into account the position and velocity of the cued and TLO track files as well as other discriminators such as brightness, return strength, size, shape etc. The cost function may, for example, comprise the distance between cued and TLO track files weighted by other discriminators and summed over all of the nodes in the template. The weapon ranks the permutation based on the cost function and repeats the process for different permutations until the weapon is within commit range. The weapon may revisit and update previously ranked permutations, particularly highly ranked permutations. At this point, each weapon selects its assigned target (one of the nodes in the template) from the highest ranked permutation and commits to that target.

In one embodiment, the template may place no constraints on the relative positions of the cued targets i.e. no constraints on the relative positions of nodes 52 in template 50. In this case, the cost function is the sum of the "distances" between each cued track file and its assigned TLO possibly weighted by other discriminators. In another embodiment, the knowledge of the relative positions of the cued track files based on the initial cues and any IFTUs may be used to further constrain the scene correlation. In this case, the weapon fixes the relative position of the nodes 52 in the template 50 and shifts (e.g. translates, rotates, etc.) the template 50 to provide a best fit to the permutation 44 of the TLO track files. Note, the relative position of the nodes may be absolute in the sense of a direction and distance between cued track files or may be relative in the sense of a relationship between assigned targets (e.g. node 2 is assigned the target to the right of node 1). The cost function is a weighted sum of a first metric of this best fit and a second metric of the degree of shift required to achieve the best fit. For example, the first metric of the best fit may be a sum of the squared distances between the shifted nodes and the TLO track files (possibly weighted by other discriminators) and the second metric of the shift may be the squared distance the template was shifted. In this latter case, the cost function measures both how well the candidate target package of the current permutation fits the cued target package and how far the candidate target package is from the cued target package.

Figure 4:
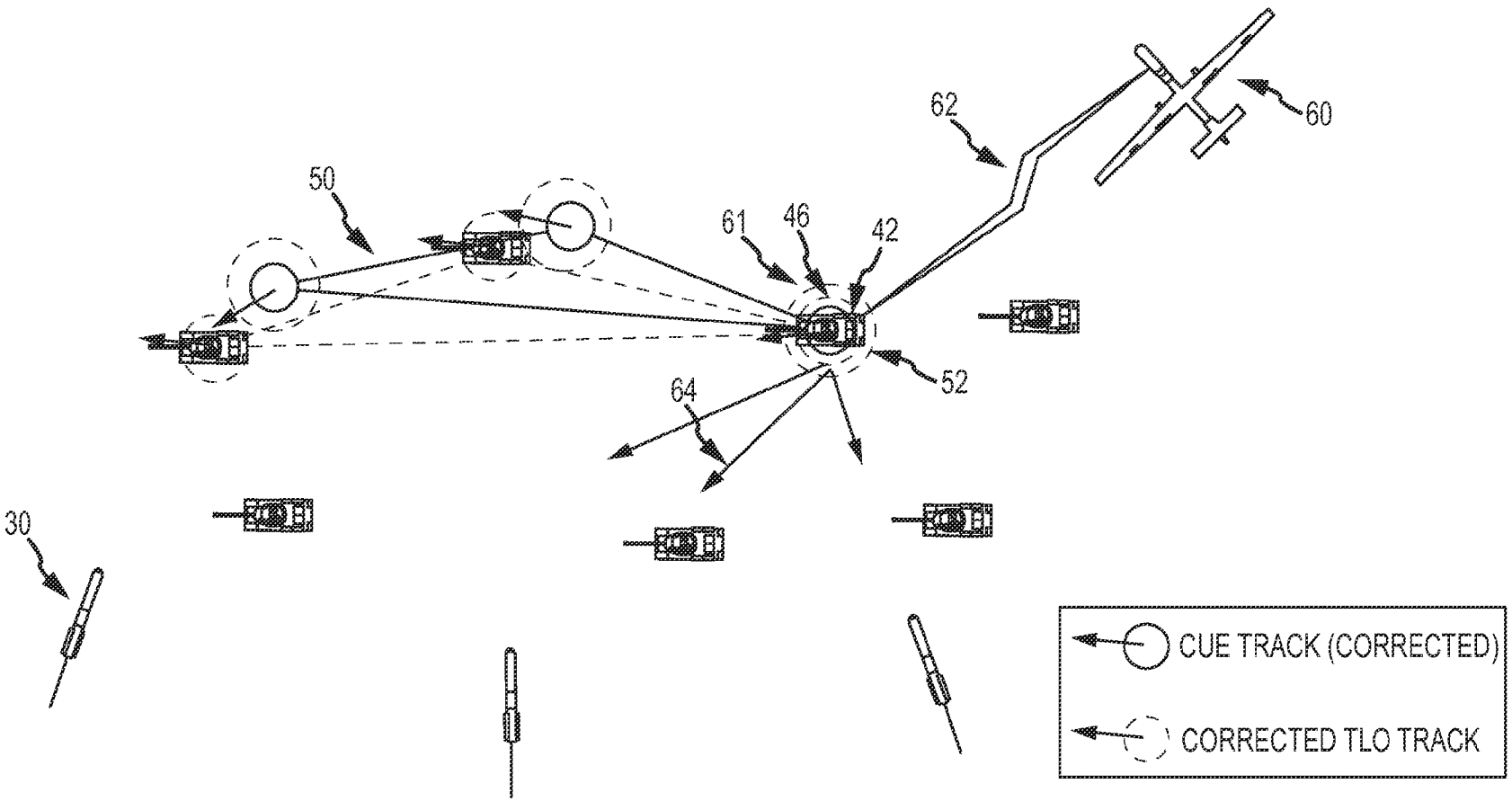
FIG. 4 is a diagram illustrating the use of a single laser designation to augment scene correlation for all missiles in the salvo in accordance with the present invention.

As shown in FIG. 4, in an embodiment each missile 30 comprises a non-imaging semi-active laser (SAL) sensor as part of a multimode seeker. The target package passed to each missile includes target cues for a common designated target including a SAL code for verifying the authenticity of a sensed SAL return. The common designated target may be an actual target 38 assigned to one of the missiles as shown here or may be a reference target that is not assigned to any missiles and, in fact, may be actively excluded from targeting by any of the missiles in the salvo.

A SAL designator 60 such as a ground or airborne designator either from the launch platform or a cooperative platform lases a common designated target 61 with a laser beam 62. The laser beam is coded with the SAL code that is provided to each missile as part of its target package. Each missile's multimode seeker and SAL sensor detects a SAL return 64 that is reflected off of the target. Each missile processes the SAL return to verify the common SAL code and augment their scene correlations by fixing the TLO track file 46 of the common designated target 61 to the cued track file 42 associated with the designated target ID. This is accomplished by correcting that cued track file 42 so that its node 52 coincides with the designated TLO track file 46.

Target designation may be used in either the "anoint" or "designation" modes. In designation mode, there is no ambiguity as to the common designated target as the laser stays on target until impact. In anoint mode, TLO closest to the laser spot is selected during the time the target is lased. Lock is maintained on the selected TLO throughout the end game. Some ambiguity may arise if multiple targets are near the lased spot and in motion.

Fixing a node 52 in the template 50 to the common designated target effectively removes many permutations from consideration, either directly because one node is fixed to a designated target or indirectly because the cost function associated with the best fit of the remaining nodes in the template to a permutation becomes very large. At terminal, each weapon references its target ID to the augmented scene correlation of its target package to commit to a particular target. In this manner, a single SAL designation can improve the tracking of all the weapons to their respective targets not just the one weapon that is assigned the designated targets.

Figure 5:
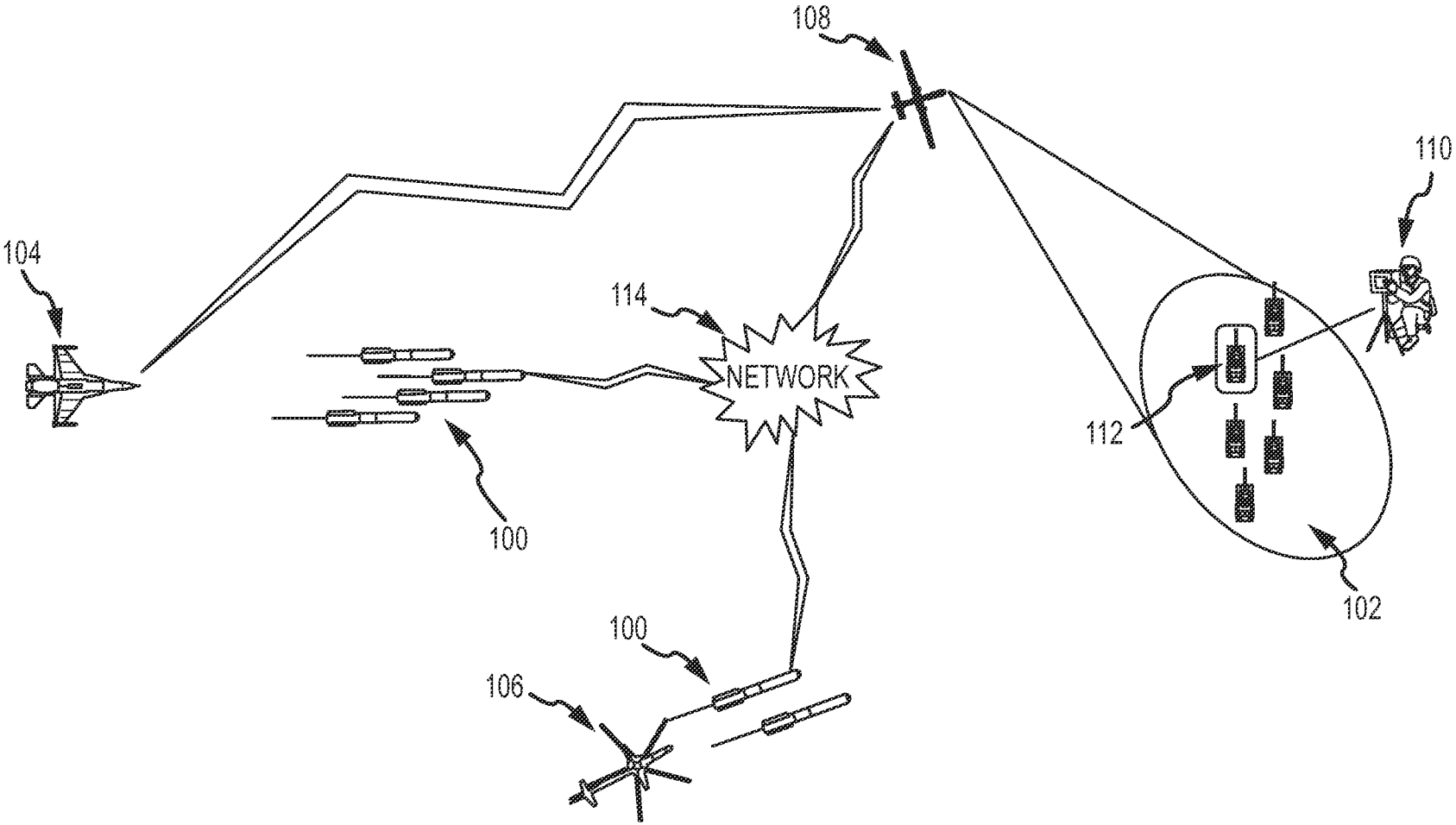
FIG. 5 is a diagram of an embodiment of a system of multiple launch platforms and a UAV to cue and launch a salvo of missiles to engage a target package.
Figure 6:
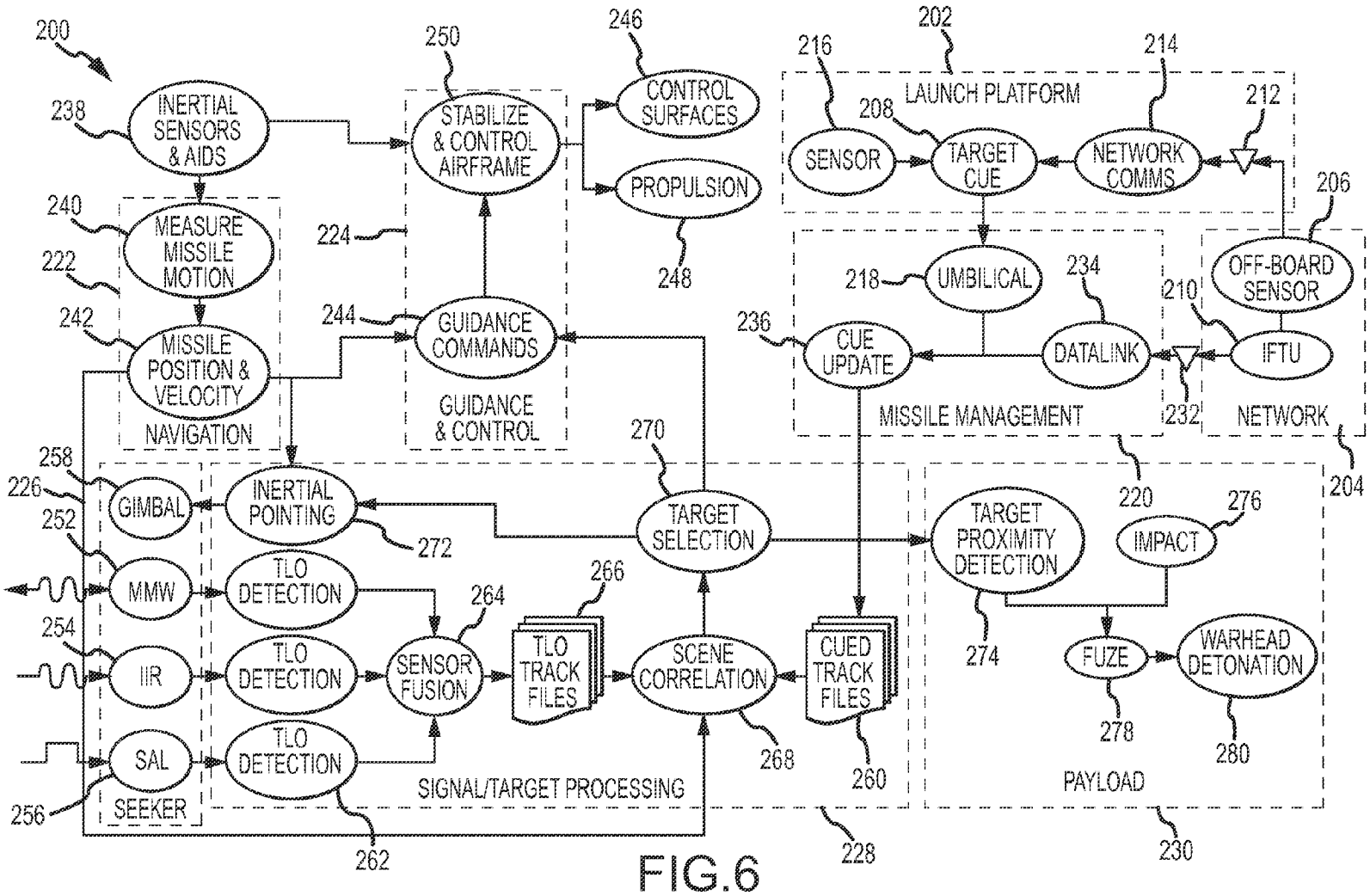
FIG. 6 is a block diagram of an embodiment of a multi-mode missile and other assets.

As shown in an embodiment in FIG. 5, a number of assets are networked to launch a salvo of missiles 100 and coordinate their mid-course and end game flight to engage a target set 102. In this scenario the assets include multiple launch platforms such as a jet fighter 104 and a helicopter 106, an external cueing source such as a UAV 108 and a SAL designator 110. In alternate embodiments, the salvo could be launched from a single platform, the cueing source could be located on one or more of the platforms or the SAL designator could be located with either the external cueing source or the platform.

UAV 108 images target set 102 to generate initial cues for individual targets 112. UAV 108 communicates these initial cues via a communication network 114 to missiles 100, either directly or via their platforms. The common SAL code for SAL designator 110 and the common designated target are communicated to each of the missiles 100 in the salvo. This may be done pre-flight based on knowledge of the SAL code for the designator in the theater of operations and upon agreement of which target will be designated or this may be done in-flight via communication between the SAL designator and the missiles/platforms.

The launch of the missiles 100 from both jet fighter 104 and helicopter 106 is coordinated so that the combined salvo of missiles arrives at the target set at approximately the same time (the missile's uncertainty volumes overlap both in space and time). The missiles may receive IFTUs for the target cues as they fly towards the target set. Once within range of its imaging sensor, the missile acquires and tracks TLOs and performs a scene correlation of its cued targets to the tracked TLOs. The missile correlates a "template" of its target package to different permutations of tracked TLOs and ranks the permutations based on a cost function that measures a "distance" or "fit" between the permutation and template. The missile may use knowledge of the expected relative positions of the cued targets to further constrain the template. If the missile's SAL detector detects a valid SAL return, the missile uses the SAL designation to augment its scene correlation by fixing the lased TLO (or closest TLO thereto if using offset designation) to the common designated target in its target package. The missile corrects the cued target (and node) and fixes it to the lased TLO. Once the missile is within its commit range, the missile references its assigned target to the tracked target package (e.g. assigned node in the template) and commits to that target.

A block diagram of an embodiment of different sub-systems on-board a missile 200, its launch platform 202 and an external network 204 that provides initial target cues and IFTUs.

Network 204 may comprise an off-board sensor 206 such as a passive IR sensor or an active RF/MWM sensor that images a target set to identify TLOs and generate cues such as position, velocity, brightness etc. Network 204 may pass the initial target cues 208 directly to the missile or to the missile via launch platform 202. Once the missile has been launched, network 204 will typically pass IFTUs 210 directly to the missile. In some instances, the network 204 may pass the IFTUs to the platform, which then relays the IFTUs to the missiles via a wireless connection.

Launch platform 202 may comprise an antenna 212 and network communications 214 for communicating with network 204 to receive the initial target cues 208 and an on-board sensor 216 such as an IR or RF/MWM sensor to generate the initial target cues 208. The initial target cues 208 may be passed from launch platform 202 to the missile via a hard-wired umbilical cable 218. Launch platform 202 may also comprise various mechanical and electrical subsystems for mounting, powering and launching the missile as well as transporting the missile.

Missile 200 comprises various sub-systems to implement scene correlation to acquire and track a target package and to commit to its assigned target. These sub-systems may comprise missile management 220, navigation 222, guidance and control 224, multimode seeker 226, signal/target processing 228 and payload 230. These sub-systems may comprise one or more computer processors and memory to perform various functions to implement the scene correlation and SAL designation.

Missile management 220 may comprise umbilical 218 to receive the initial target cues 208 from launch platform 202 and an antenna 232 and datalink 234 to receive IFTUs 210 from network 204. The initial or IFTUs are than provided as cue update 236 to the signal/target processing sub-system 228.

Navigation 222 and guidance and control 224 receive data from a package of inertial sensors and aids 238 such as an inertial measurement unit (IMU) and a GPS receiver, radar altimeter, digital scene matching and correlation (DSMAC) etc. Navigation 222 may comprise computer processor(s) and memory configured to measure missile motion 240 and compute missile position and velocity 242. Guidance and control 224 responds to the missile's position and velocity and a cued track file for the missile's assigned target to generate guidance commands 244 to maneuver the missile towards the assigned target. Guidance and control 224 processes these guidance commands and the inertial data to command control surfaces 246 (fins, canards, wings, etc) and propulsion 248 to stabilize and control the airframe 250.

Multimode seeker 226 may comprise one or more imaging sensors such as an active MMW sensor 252 and a passive IIR sensor 254 and a non-imaging SAL sensor 256. The imaging sensors output a sequence of MMW (RF) or IR images. The SAL sensor is typically a quad-detector that outputs the x,y coordinates or az/el coordinates of a centroid of incident energy. The seeker may be fixed or mounted on a 1- or 2-axis gimbal 258 that responds to a pointing command from signal/target processing to slew the seeker. The various sensors may have a limited instantaneous FOV. The gimbal may slew the seeker to scan the FOV to cover a search volume or acquire a SAL designation return.

Signal/target processing 228 receives as inputs the cue update 236 from missile management, missile position and velocity 242 from navigation and the sensors' images or coordinates from seeker 226 and generates as outputs the position of a selected target for guidance and control 224 and payload 230. Signal/target processing 228 may initialize and propagate cued track files 260 based on the cue updates 236 received from missile management for each of the multiple targets in the missile's target package. These cued track files 260 may comprise a time-stamped position and velocity and an uncertainty volume for each and possibly other discriminators. Signal/target processing 228 detects TLOs 262 from the returns of the imaging and SAL sensors and fuses those results 264 to initiate and propagate TLO track files 266. The TLO track files 266 may comprise time-stamped position and velocity and an uncertainty volume for each and possibly other discriminators. Signal/target processing 228 performs a scene correlation 268 of the cued track files 260 to different permutations of the TLO track files 266 and updates a current target selection 270. Signal/target processing 228 augments the scene correlation if a verified SAL return is detected. The current target selection 270 may be provided to guidance and control 224 to maneuver the missile or used with the current missile position and velocity to compute an inertial point 272 towards the target to control gimbal 258. This provides a nominal orientation in which to point the gimbal, which may then be slewed over a much larger search volume to acquire other cued targets in the target package.

Once the missile is within a range to commit, signal/target processing 228 passes the target selection to payload 230. Payload 230 may comprise a target proximity detection 274 or impact 276 sensor to light a fuze 278 to achieve warhead detonation 280.

Figure 7:
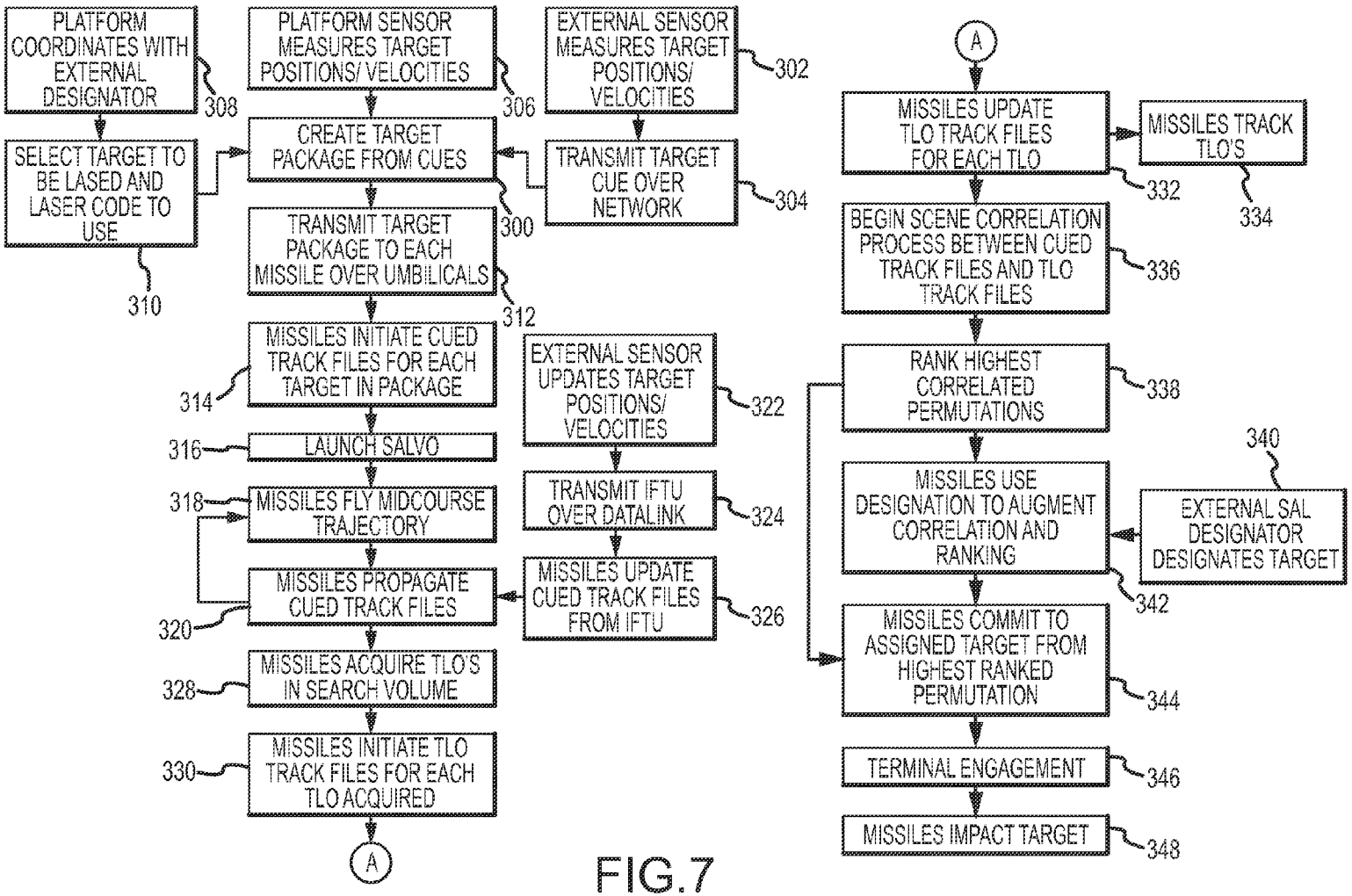
FIG. 7 is flow diagram of an embodiment for deconflicting missiles fired in a salvo to engage a target space.

An embodiment of a flow diagram of the process for acquiring and tracking multiple targets in a target package using scene correlation and SAL designation if available and committing to an assigned target in the target package to deconflict missiles fired in a salvo is illustrated in FIG. 7. The process creates a target package from cues for multiple different targets in the target space (step 300). The initial target cues may be measured and provided either by an external cueing sensor that identifies potential targets and measures their positions and velocities (step 302) and transmits those target cues over the network (step 304) to the platform and missile or by a sensor on-board the platform (step 306). If SAL designation is contemplated, the platform coordinates with an external SAL designator (step 308) to select the common designated target to be lased the common SAL code to be used (step 310). In an embodiment, the platform(s) creates one target package that is distributed to all of the missiles to be fired in the salvo. In another embodiment, the platform(s) creates a target package for each missile that comprises at least that missile's assigned target and the common designated target.

In step 312, the platform(s) transmit the target package to each missile over an umbilical. Each missile initiates a cued track file for each target in its target package (step 314). The salvo of missiles is launched (step 316) and the missiles fly a midcourse trajectory towards the target set (step 318) while continuing to propagate the cued track files (step 320). If available, the same or a different external cuing sensor can provide updates to the positions/velocities of targets in the target packages (step 322) and transmit the IFTUs over a datalink to the missile (step 324). Each missile updates its cued track files from the IFTUs (step 326).

Once in range of its imaging sensor(s), each missile acquires a number of TLOs in a search volume (step 328) and initiates TLO track files (step 330) for each TLO acquired. Each missile suitably scans a search volume that spans the combined uncertainty volumes of the cued track files in its target package. As the salvo flies toward the target set, the missiles update the TLO track files (step 332) and track the TLOs (step 334). Each missile begins the scene correlation process between the cued track files in its target package and different permutations of TLO track files (step 336) and ranks the highest correlated permutations (step 338). If an external SAL designation of the common designated target is available (step 340), the missiles use that designation to augment the scene correlation and ranking (step 342). In this manner, all of the missiles benefit from the existence of a SAL designation of a single target. Once in commit range, the missiles commit to an assigned target from the highest ranked permutation (step 344) and the missile enters terminal engagement (step 346) to impact their assigned targets (step 348). The use of scene correlation, possibly augmented with a SAL designation reduces targeting ambiguity and conflict among the multiple missiles in the salvo to prosecute the multiple targets in the target set.

Figure 8:
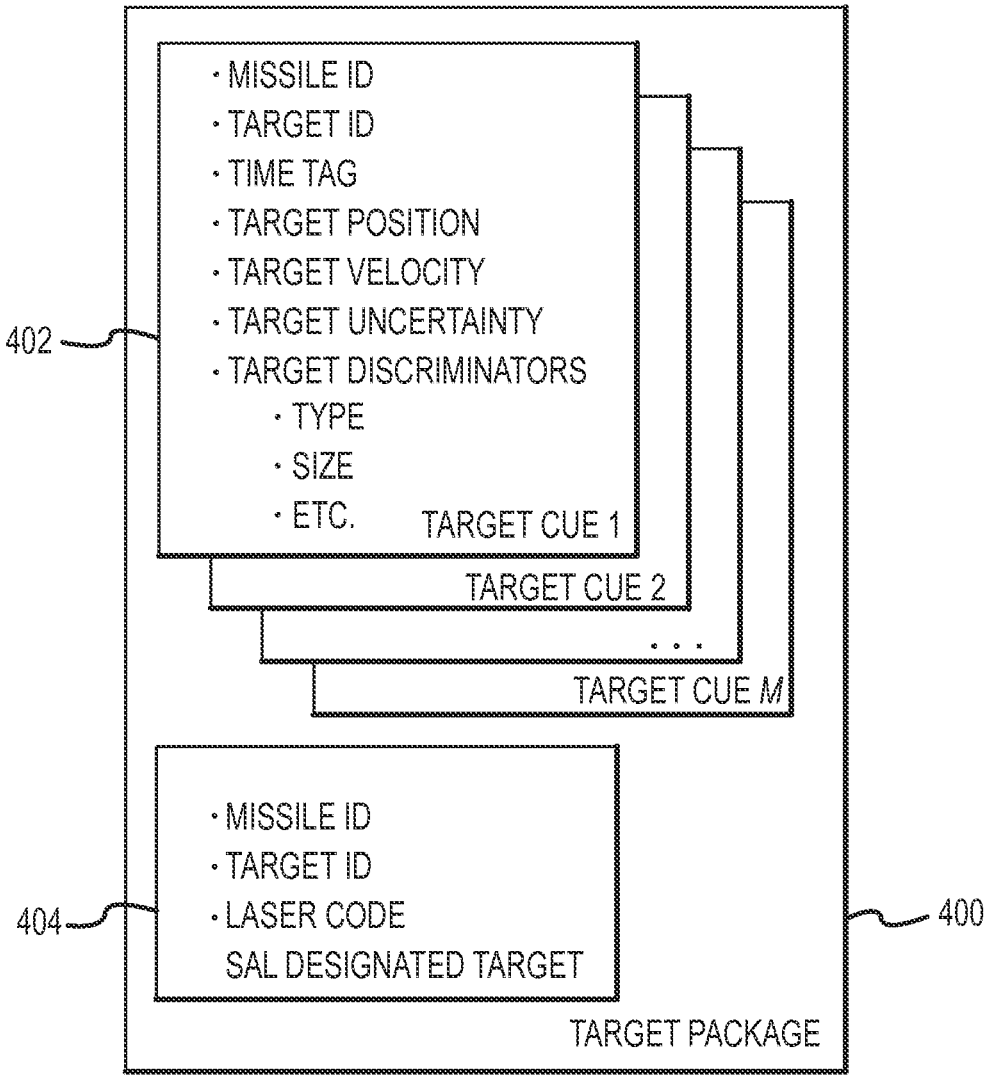
FIG. 8 is a diagram of an embodiment of a target package including target cues for each target and a common designated target.

An embodiment of a target package 400 passed from a launch platform to one or more missiles is illustrated in FIG. 8. Target package 400 includes target cues 402 for a plurality of targets and information for a common designated target 404. A target cue 402 might comprise a missile ID, a target ID that assigns the cued target to the missile ID, a time tag or stamp, target position, target velocity, position uncertainty, velocity uncertainty and one or more target discriminators such as type, size, shape etc. The information for the SAL designated target may comprise the target ID that will be designated, the missile ID that is assigned to the common designated target and a SAL laser code that will be embedded in the laser designation and must be validated by the missile. In one embodiment, a single common target package 400 is created and passed to all missiles. Each missile performs the same scene correlation and SAL designation augmentation. The only difference being that each missile selects its assigned target from the highest ranked permutation. In another embodiment, each target package 400 comprises that missiles assigned target and the common designated SAL target. Each missile performs a scene correlation to its target and the common SAL designated target. Other embodiments of the target package 400 may include the assigned target, one or more targets close to the assigned target and the SAL designated target if one exists.

Figure 9:
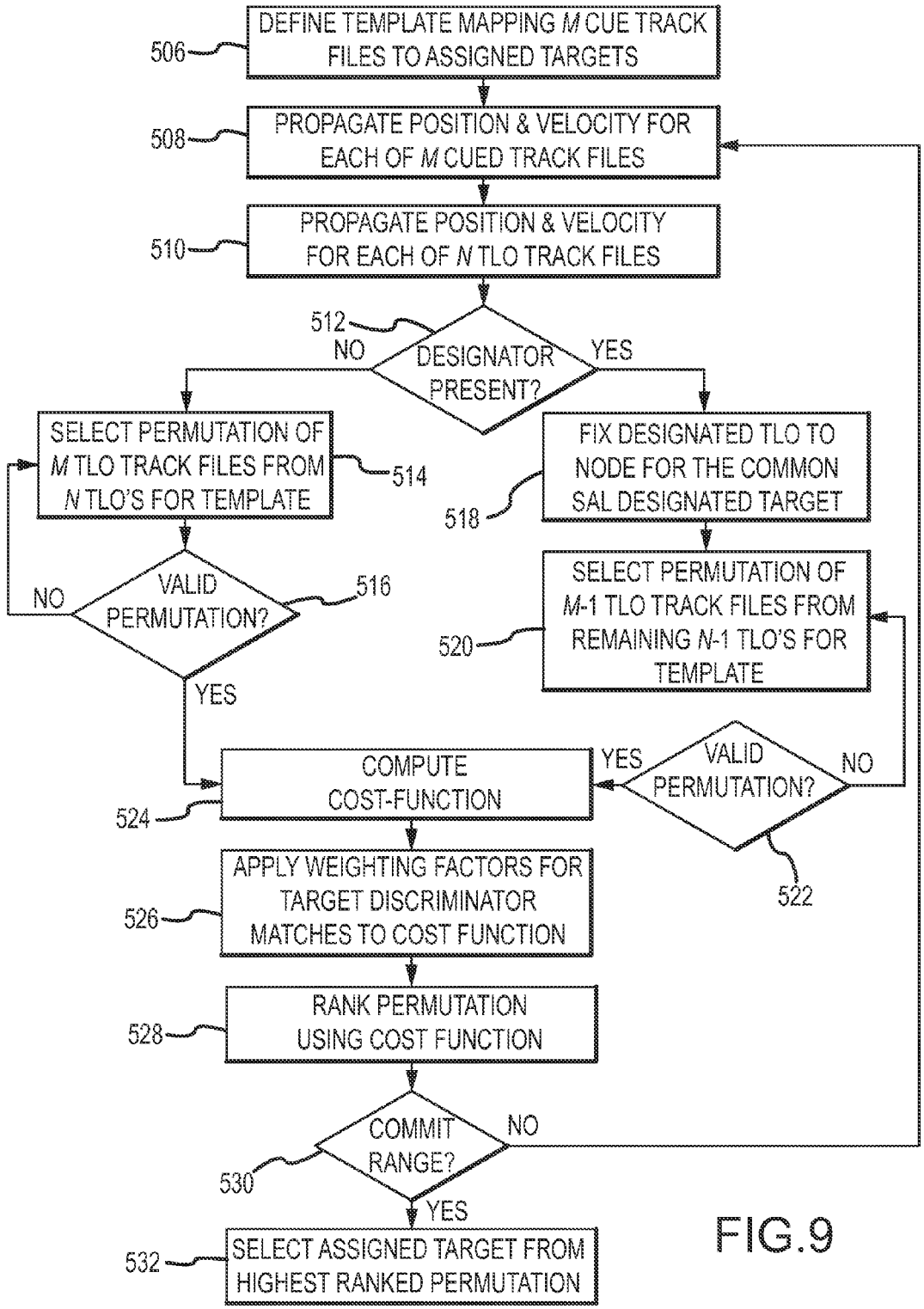
FIG. 9 is a flow diagram of an embodiment of a scene correlation algorithm for correlating the cued salvo of missiles to candidate targets in the target space.
Figure 10A:
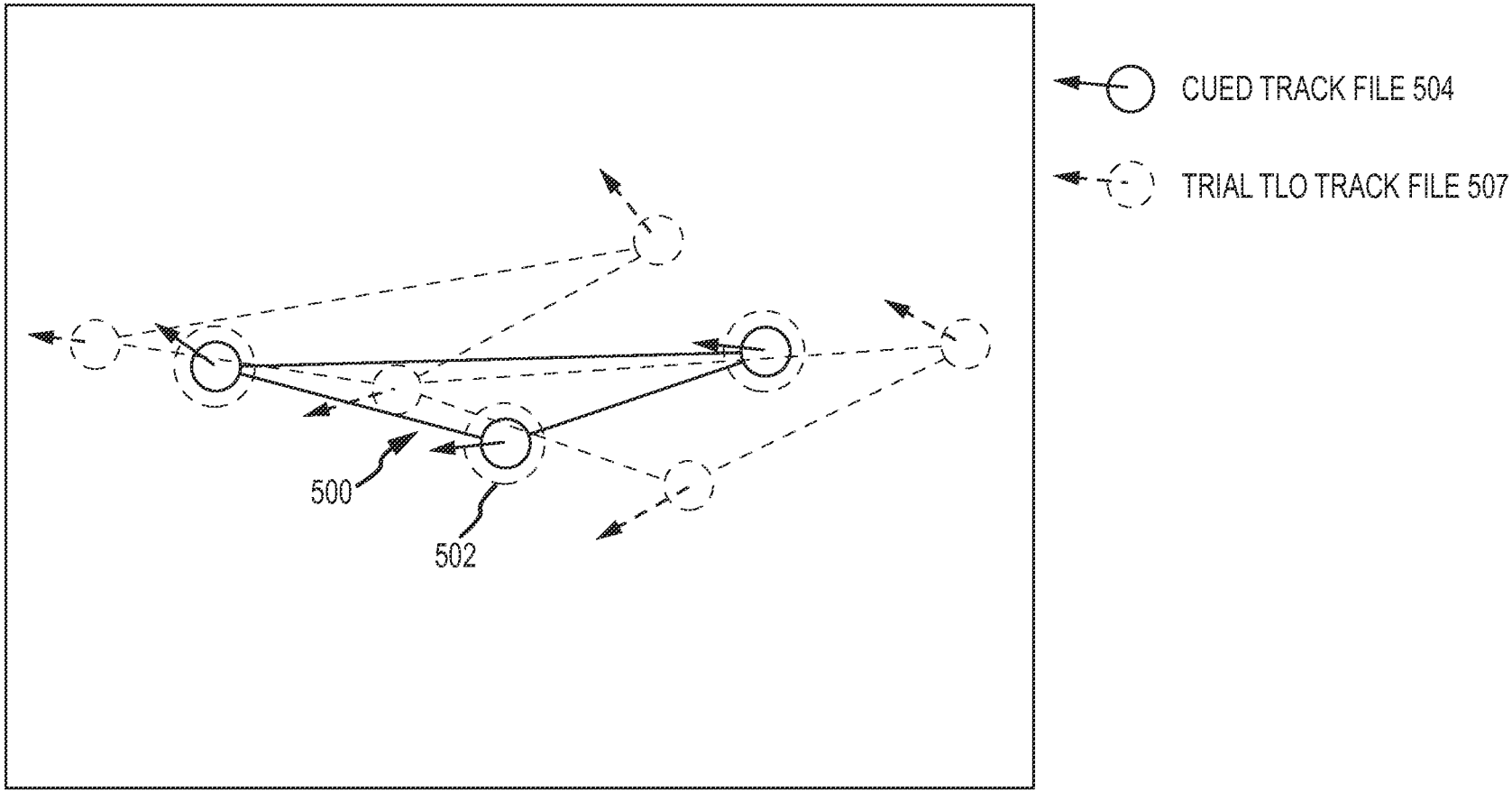
FIGS. 10*a* and 10*b* are diagrams illustrating the use of a single SAL designation to eliminate ambiguity in the scene correlation for multiple missiles.
Figure 10B:
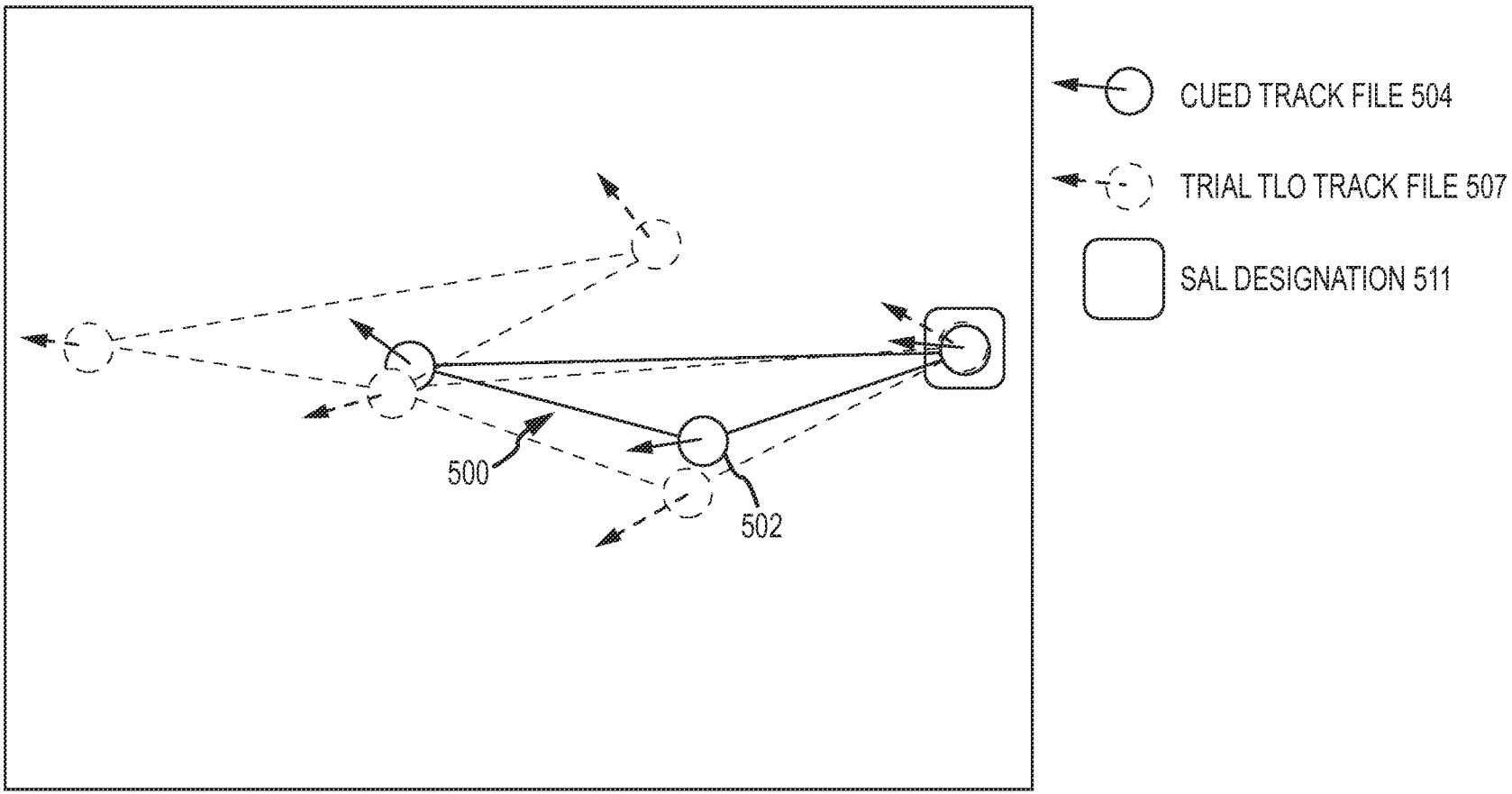

In an embodiment illustrated in FIGS. 9 and 10*a*-10*b*, the missile, and more particularly one or more computer processors and memory, are configured to implement a sequence of computer processing steps to perform a scene correlation to track multiple targets in a target set and to augment that correlation with a common SAL designation. The missile defines a template 500 that comprises a plurality of M nodes 502 that map each of the M cued track files 504 in the target package to an assigned target (step 506). Typically, each node (missile) is assigned to a different target, however in some cases it may be desirable to task multiple missiles to a target. The missile propagates the position and velocity for each of the M cued track files 504 and each of N trial TLO track files 507 where N greater than or equal to M (steps 508 and 510).

The missile then determines whether a valid SAL designator 511 is present (step 512). If no, the missile selects a permutation of M trial TLO track files from the N TLO track files and assigns them to nodes in the template according to the target assignment in the target package (e.g. one target per node) (step 514). To improve the search efficiency, the missile suitable determines whether the permutation is valid (step 516). A valid permutation must not only satisfy the target assignment mapping but must assign a trial TLO track file to a node that lies within the uncertainty volume of the cued track file associated with that node. If yes, the missile fixes the TLO track file of the designated target to the node for the common SAL designated target (step 518). This is done by correcting the cued track file for the common designated target to coincide with the lased spot or TLO closest to the lased spot. The missile than selects a permutation of M−1 trial TLO track files from the remaining N−1 TLO track files and assigns them to the remaining nodes in the template according to the target assignment (step 520). Again to improve the search efficiency, the missile suitable determines whether the permutation is valid (step 522). The number of permutations for M cued targets in N TLOs is P(N,M)=N!/(N−M)! If N>M this number gets big fast. The validation step may significantly reduce the number of permutations that should be tested. The use of SAL designation directly reduces the number of permutations by reducing M and N by one. The SAL designation also allows the missile to identify permutations that although valid are unlikely and thus are not worth tracking.

In an embodiment, the missile computes a cost-function as a measure of the fit between the template and the current permutation (step 524). The cost function measures a "distance" between the cued targets in the target package and the TLOs in the current permutation. The "distance" metric may take into account the position and velocity of the cued and TLO track files as well as other discriminators such as brightness, return strength, size, shape etc. The cost function may, for example, comprise the distance between cued and TLO track files weighted by other discriminators (step 526) and summed over all of the nodes in the template.

In one embodiment, the template may place no constraints on the relative positions of the cued targets i.e. no constraints on the relative positions of nodes 502 in template 500. In this case, the cost function may comprise the weighted sum of the squared differences between each cued track file and its assigned TLO. For example, let $X_c^i$, $V_c^i$ be the position and velocity of the cue for the $i^{th}$ node and $X_t^i$, $V_t^i$ be the position and velocity of the TLO that is mapped to the $i^{th}$ node in the current permutation. A cost function J may be represented as: $J=\Sigma_i w_x*(X_c^1-X_t^i)^2+w_v*(V_c^i-V_t^i)^2$ for i=1 to M where $w_x$ and $w_v$ are weighting functions for position and velocity. A weighting factor representative of the discriminator match between the assigned target and the TLO may be applied to J by multiplication/division or addition/subtraction. The missile ranks the permutation using the cost function (step 528) and repeats the process with updated cued and TLO track files for a different permutation. A permutation is ranked highly if its cost function is small, which occurs when each of the TLOs in the permutation is close to its cued target.

In another embodiment, the knowledge of the relative positions of the cued track files based on the initial cues and any IFTUs may be used to further constrain the scene correlation. In this case, the weapon fixes the relative position of the nodes 502 in the template 500 and shifts (e.g. translates, rotates, etc.) the template 500 to provide a best-fit to the permutation of the TLO track files. Note, the relative position of the nodes may be absolute in the sense of a direction and distance between cued track files or may be relative in the sense of a relationship between assigned targets (e.g. node 2 is assigned the target to the right of node 1). In this case, the cost function may be a weighted sum of a first metric of this best-fit and a second metric of the degree of shift required to achieve the best-fit. For example, the first metric of the best-fit may be a weighted sum of the squared differences between the shifted nodes and the TLO track files and the second metric of the shift may be the squared distance the template was shifted. In this latter case, the cost function measures both how well the candidate target package of the current permutation fits the cued target package and how far the candidate target package is from the cued target package.

For example, let $X_c^{i*}$, $V_c^{i*}$ be the position and velocity of the cue for the $i^{th}$ node reflecting the translation of the template by "S" to achieve a "best-fit" and $X_t^i$, $V_t^i$ be the position and velocity of the TLO that is mapped to the $i^{th}$ node in the current permutation. A cost function J may be represented as:

$J=[\Sigma_i w_x*(X_c^{i*}-Xt^i)^2+w_v*(V_c^{i*}-V_t^i)^2)]+w_s*S^2$ for i=1 to M where $w_x$ and $w_v$ are weighting functions for position and velocity and $w_s$ is a weighting function for the shift of the template. Note, when the SAL designator is present the distance "S" is constant for all permutations. Consequently, the cost function defaults to measurement of which permutation provides the best-fit to the template.

The missile ranks the permutation using the cost function (step 528) and repeats the process with updated cued and TLO track files for a different permutation until the weapon is within commit range (step 530). The weapon may revisit and update previously ranked permutations, particularly highly ranked permutations. At this point, each weapon selects its assigned target (one of the nodes in the template) from the highest ranked permutation and commits to that target (step 532).

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A method of deconflicting a salvo of airborne weapons, comprising:

passing respective target packages to a plurality of airborne weapons including imaging sensors on one or more launch platforms, each said target package including individual target cues of initial position, velocity and uncertainty estimates for a plurality of targets and a target ID for the weapon;

launching a salvo of said airborne weapons at a range to a target at which the weapon's imaging sensors are unable to acquire the targets;

during flight of each airborne weapon, propagating a cued track file for each individual target cue in its target package to maintain current estimates of each target's position, velocity, and uncertainty volume;

using the imaging sensor to image a search volume to acquire target like objects (TLOs) and propagate TLO track files; and performing a scene correlation of the cued track files to the TLO track files to acquire and track the target package; and at terminal, referencing each weapon's target ID to the tracked target package to commit each weapon to a particular target.

2. The method of claim 1, wherein one uniform target package including individual target cues for all of the targets is passed to each of the weapons.

3. The method of claim 1, wherein the target packages include individual target cues for targets to which no weapon is assigned.

4. The method of claim 1, wherein each airborne weapon comprises a non-imaging semi-active laser (SAL) sensor, said target packages including target cues including a common SAL code for a common designated target, further comprising:

said airborne weapons using their SAL sensors to detect and process a SAL return to verify the common SAL code and augment their scene correlations by fixing the TLO track file of the common designated target to the cued track file associated with the designated target ID.

5. The method of claim 4, wherein at least one said weapon is assigned to commit to the common designated weapon.

6. The method of claim 5, wherein the target cues for the common designated target comprise a target ID that identities a particular target from among the plurality of targets.

7. The method of claim 5, wherein the target cues for the common designated target comprise a target ID that identities any target from among the plurality of targets.

8. The method of claim 5, wherein said target packages include only a single common SAL code for a single common designated target.

9. The method of claim 4, wherein no weapon is assigned to the designated target.

10. The method of claim 9, further comprising each said weapon implementing logic that prevents the weapon from committing to the designated target.

11. The method of claim 4, wherein each said target package includes only the individual cues for the designated target and the assigned target for that weapon.

12. The method of claim 1, wherein the imaging sensor images a search volume that spans the combined uncertainty volumes of the targets in the target package to acquire target like objects (TLOs).

13. The method of claim 12, wherein the imaging sensor has an instantaneous field of view (FOV) that is smaller than the search volume, further comprising steering the imaging sensor's instantaneous FOV over the search volume.

14. The method of claim 1, wherein the weapons' perform the scene correlation by:

a) defining a template comprising a plurality of nodes that map each of the cued track files in the target package to an assigned target;

b) selecting a permutation that assigns a TLO track file to each node in the template;

c) computing a cost function between the multiple cued and TLO track files in the template for the permutation;

d) ranking the permutation based on the cost function;

e) repeating steps b through d for different permutations until the weapon is within a commit range; and f) at terminal, committing to the assigned target from the highest ranked permutation.

15. The method of claim 14, wherein the cost function is a metric of distances between the cued and TLO track files at each node in the template.

16. The method of claim 14, wherein the relative position of the nodes in the template is constrained by the relative positions of the cued track files, wherein said cost function is a weighted sum of a first metric associated with a best-fit of the template to the TLO track files in the permutation and a second metric associated with shift of the template from absolute positions of the cued track files to achieve the best-fit.

17. The method of claim 14, wherein the weapon determines if the selected permutation is valid by verifying whether the TLO track file assigned to a node is within the uncertainty volume of the cued track file for that node.

18. The method of claim 14, wherein the individual cues comprise cued target discriminators, said imaging sensor's estimating TLO discriminators, further comprising weighting the cost function based on a similarity of the TLO discriminators to the cued target discriminators.

19. A method of deconflicting a salvo of airborne weapons, comprising:

passing respective target packages to a plurality of airborne weapons on one or more launch platforms, each said weapon comprising a multimode seeker including an imaging sensor and a SAL sensor, each said target package including individual target cues of initial position, velocity and uncertainty estimates for a plurality of targets of which one is a common designated target, a common SAL code and a target ID for the weapon;

launching a salvo of said airborne weapons at a range to a target at which the weapon's imaging sensors are unable to acquire the targets;

during flight of each airborne weapon, propagating a cued track file for each individual target cue in the target package to maintain current estimates of each target's position, velocity, and uncertainty volume;

using the imaging sensor to image a search volume to acquire target like objects (TLOs) and propagate TLO track files; and performing a scene correlation of the cued track files to the TLO track files to acquire and track the target package;

using the SAL sensor to detect and process a SAL return to verify the common SAL code and augment their scene correlations by fixing the TLO track file of the common designated target to the cued track file associated with the designated target ID; and at terminal, referencing each weapon's target ID to the augmented scene correlation of the target package to commit each weapon to a particular target.

20. The method of claim 19, wherein one uniform target package including individual target cues for all of the targets is passed to each of the weapons.

21. The method of claim 19, wherein each said target package includes only the individual cues for the designated target and the assigned target for that weapon.

22. The method of claim 19, wherein the imaging sensor images a search volume that spans the combined uncertainty volumes of the targets in the target package to acquire target like objects (TLOs).

23. The method of claim 19, wherein the weapons' perform the scene correlation by:

a) defining a template comprising a plurality of nodes that map each of the cued track files in the target package to an assigned target;

b) determining if a verified SAL return is present, if no, selecting a permutation that assigns a TLO track file to each node in the template; and if yes, fixing the TLO track file of the common designated target to the node assigned to the cued track file of the designated target ID and selecting a permutation that assigns a TLO track file to each of the remaining nodes in the template;

c) computing a cost function between the multiple cued and TLO track files in the template for the permutation;

d) ranking the permutation based on the cost function;

e) repeating steps b through d for different permutations until the weapon is within a commit range; and f) at terminal, committing to the assigned target from the highest ranked permutation.

24. The method of claim 23, wherein the relative position of the nodes in the template is constrained by the relative positions of the cued track files, wherein said cost unction is a weighted sum of a first metric associated with a best-fit of the template to the TLO track files in the permutation and a second metric associated with shift of the template from absolute positions of the cued track files to achieve the best-fit.

25. A method of deconflicting a salvo of airborne weapons, comprising:

passing a uniform target package to a plurality of airborne weapons on one or more launch platforms, each said weapon comprising a multimode seeker including an imaging sensor and a SAL sensor, said uniform target package including individual target cues of initial position, velocity and uncertainty estimates for a plurality of targets of which one is a common designated target, a common SAL code and a target ID for the weapon;

launching a salvo of said airborne weapons at a range to a target at which the weapon's imaging sensors are unable to acquire the targets;

during flight of each airborne weapon, propagating a cued track file for each individual target cue in the target package to maintain current estimates of each target's position, velocity, and uncertainty volume;

using the imaging sensor to image a search volume of the combined uncertainty volumes of the targets in the target package to acquire target like objects (TLOs) and propagate TLO track files; and performing a scene correlation of a template comprising nodes of the cued track files to the TLO track files to acquire and track the target package;

using the SAL sensor to detect and process a SAL return to verify the common SAL code and augment their scene correlations by fixing the TLO track file of the common designated target to the cued track file associated with the designated target ID; and at terminal, referencing each weapon's target ID to the augmented scene correlation of the target package to commit each weapon to a particular target.

* * * * *

UNITED STATES PATENT AND TRADEMARK OFFICE

CERTIFICATE OF CORRECTION

PATENT NO. : 8,487,226 B2
APPLICATION NO. : 13/050600
DATED : July 16, 2013
INVENTOR(S) : Brian L. Biswell It is certified that error appears in the above-identified patent and that said Letters Patent is hereby corrected as shown below:

In the Claims:

In column 13, claim 7, line 20, delete “identities” and insert --identifies--;

In column 15, claim 24, line 5, delete “unction” and insert --function--.

Signed and Sealed this
Third Day of September, 2013

Teresa Stanek Rea
*Acting Director of the United States Patent and Trademark Office*